United States Patent [19]

Goloff

[11] 4,014,631

[45] Mar. 29, 1977

[54] HEAT PIPE COOLING OF A ROTARY ENGINE ROTOR

[75] Inventor: Alexander Goloff, East Peoria, Ill.

[73] Assignee: Caterpillar Tractor Co., Peoria, Ill.

[22] Filed: Dec. 1, 1975

[21] Appl. No.: 636,783

[52] U.S. Cl. ..... 418/85; 418/94; 418/178

[51] Int. Cl.[2] ..... F01C 21/06; F04C 29/04

[58] Field of Search ..... 418/85, 91–94, 418/178; 123/8.01

[56] References Cited

UNITED STATES PATENTS

| | | | |
|---|---|---|---|
| 2,112,890 | 4/1938 | Gunn | 418/94 |
| 3,098,605 | 7/1963 | Bentele et al. | 418/94 |
| 3,176,915 | 4/1965 | Bentele et al. | 418/91 |
| 3,359,956 | 12/1967 | Bentele | 418/178 |
| 3,390,667 | 7/1968 | Beurtheret | 418/94 |

FOREIGN PATENTS OR APPLICATIONS

| | | | |
|---|---|---|---|
| 941,029 | 11/1963 | United Kingdom | 418/8.01 |
| 374,042 | 5/1932 | United Kingdom | 418/94 |

*Primary Examiner*—John J. Vrablik
*Attorney, Agent, or Firm*—Frank L. Hart

[57] ABSTRACT

Improved structure for cooling the rotor of a rotary engine wherein a heat pipe structure is provided extending inwardly from an outer portion of the rotor for transferring heat inwardly to a heat transfer structure within the rotor. Heat is transferred through the heat transfer structure from the heat pipe to lubricant coolant flowed through a grooved wall inwardly of the heat pipe and outwardly of the rotor bearing. In the illustrated embodiment, the heat pipe is provided with a body of water for effecting the desired heat transfer from the rotor apex.

3 Claims, 2 Drawing Figures

FIG. 1
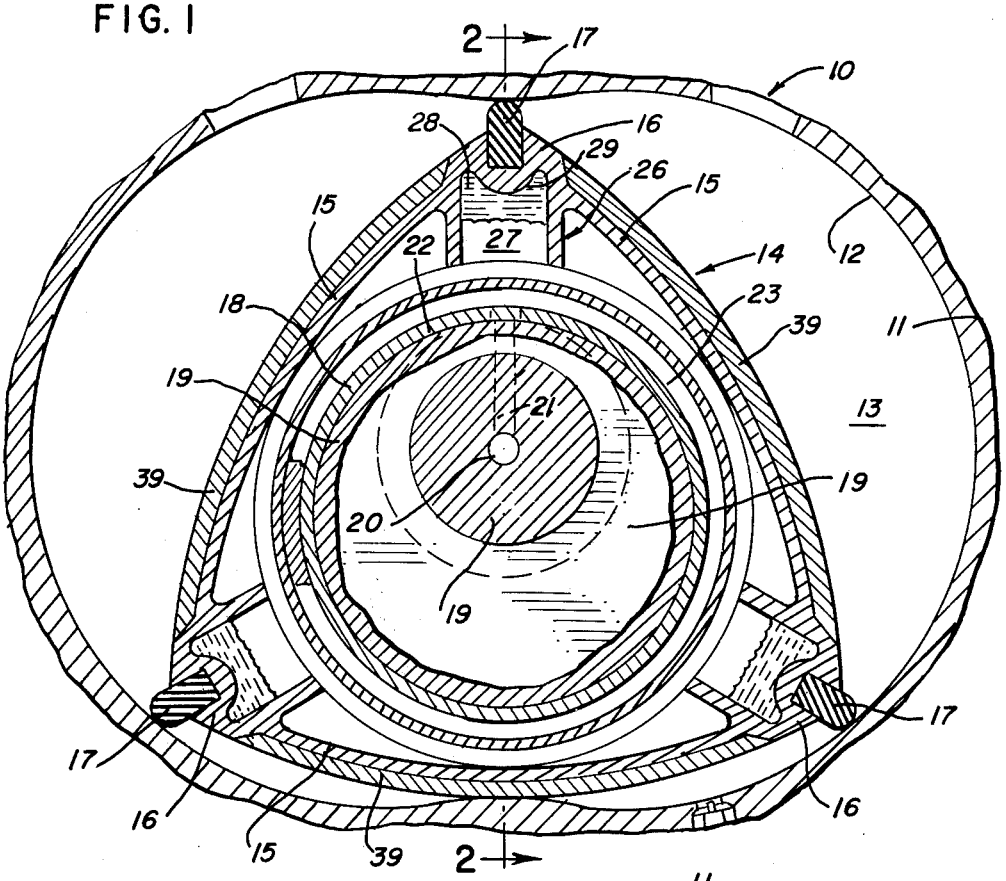
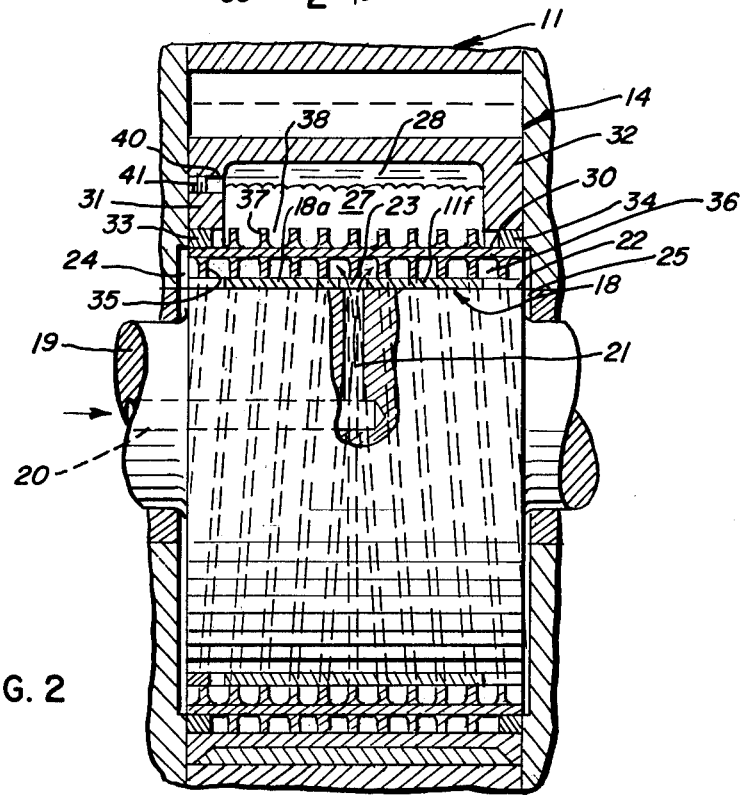
FIG. 2

HEAT PIPE COOLING OF A ROTARY ENGINE ROTOR

BACKGROUND OF THE INVENTION

1. Field of the Invention

This invention relates to rotary engines and in particular to means for cooling the rotor of such engines.

2. Description of the Prior Art

In one conventional form of rotor structure utilized in rotary engines and the like, the rotor is made hollow and is provided internally with a liquid coolant which cools the outer surfaces of the rotor by movement thereagainst as a result of the rotating centrifugal field. Lubricating oil is an example of fluids used in such heat exchange means.

A cooling arrangement for rotary mechanisms is illustrated in U.S. Pat. No. 3,042,009 of Walter G. Froede et al. In the Froede et al. patent, each apex portion of the rotor is provided with a heat transfer medium, such as sodium or copper, extending into heat transfer association with a cooling liquid circulating through the rotor. Passage means are provided for supplying a cooling liquid through an internal passage means and to the bearing means.

In U.S. Pat. No. 3,168,237 of Hanns-Dieter Paschke, a stationary hollow disc is provided within a hollow rotor. The disc includes scoop or outflow passages through which the centrifugal forces on the fluid coolant force the fluid when the fluid within the rotor reaches a level sufficient to cover the radially outer ends of the passages. A rotary, axially movable open annular channel member is carried by the rotor at one end face to bear elastically against the housing end wall. The channel member includes pocketlike recesses facing inwardly for collecting the coolant emptying from the outflow conduits in the rotor end face and facing axially outwardly for conveying the coolant to outlet passage means in the housing end wall.

Max Bentele et al., in U.S. Pat. No. 3,176,915, show a cooling system for a rotary mechanism arranged to direct a small amount of oil into compartments in the rotor at predetermined rotative positions of the rotor. The oil is substantially scavenged from the rotor compartments before the rotor reaches a predetermined position at which additional oil is directed therein permitting the rotor to run with only a relatively small amount of oil therein during rotation.

In U.S. Pat. No. 3,204,614, Reinhold Huber discloses a rotary piston for use in an internal combustion engine wherein the piston includes wall means defining a space for receiving cooling liquid extending over a substantial portion of the width of the piston in the axial direction. Means are provided for supplying cooling liquid to the space in radial directions at the corners of the piston with means for discharging the cooling liquid from the space being provided intermediate the corners.

Hanns-Dieter Paschke, in U.S. Pat. No. 3,206,109, shows fluid cooling means for the rotor of a rotary mechanism wherein a plurality of circumferentially spaced cooling compartments are provided in the rotor. Supply and drain openings are provided such that the compartment will not be completely drained and thereby cause the incoming cooling fluid to be mixed with a portion of the cooling fluid previously in the compartment for an increase in the volume of cooling fluid available for cooling the rotor walls. The inlet opening is disposed adjacent the radially inner portion of the compartment. The outlet opening may be provided in the rotor end wall.

In U.S. Pat. No. 3,705,570 of Max Ruf, a liquid cooled rotor is disclosed utilizing centrifugal forces in the shaft and rotor to pump and channel lubricating and cooling oil through the hollow rotor with the internal cavity of the rotor being contoured to assist in pumping and directing the flow. The rotor is provided with a central web extending radially inwardly substantially midway between each pair of apices. The shaft is provided with an axial bore for supplying the cooling and lubricating fluid.

SUMMARY OF THE INVENTION

The present invention comprehends an improved rotor cooling means wherein heat pipe means are provided leading inwardly from an outer portion of the rotor for transferring heat therefrom to a heat transfer medium provided within the rotor. In the illustrated embodiment, the outer portion of the rotor may comprise the apices of the rotor.

The cooling heat pipe means may comprise a fluid holder having a body of vaporizable fluid, such as water, therein. The fluid is urged outwardly by the centrifugal forces so as to be nearly always in contact with the inner surface of the rotor outer portion.

Heat transferred from the rotor outer portion to the water may cause vaporization thereof. The water vapor flows inwardly as a result of the differences in centrifugal force action thereon so as to permit transfer of the heat of vaporization to a heat transfer means within the rotor.

In the illustrated invention, the heat transfer means utilizes the bearing lubricant as a coolant heat transfer fluid. Thus, an annular wall may be provided at the inner end of the heat pipe for transferring heat therethrough to the lubricant coolant which may be flowed through a suitable flow passage for conducting the heat outwardly from the rotor.

The heat transfer wall may be provided with suitable fins projecting radially into the heat pipe for improved heat transfer.

The coolant may be delivered into heat transfer association with the wall at the mid-portion of the bearing for flow in opposite directions for improved heat transfer effect. By providing the increased heat transfer surface by the groove and fin means of the heat transfer wall, the rate of flow of the lubricant coolant may be relatively low while yet assuring effective cooling of the rotor apices by heat transfer through the heat pipe to the lubricant coolant.

The rotor surfaces between the apices may be insulated in order to limit heat flow in the rotor, thereby making it easier to cool the apices more effectively, and thereby reducing seal temperatures and prolonging engine life.

The present invention comprehends an improved rotor cooling structure for use in rotary engines and the like which is extremely simple and economical of construction while yet providing the highly desirable advantages discussed above.

BRIEF DESCRIPTION OF THE DRAWING

Other features and advantages of the invention will be apparent from the following description taken in connection with the accompanying drawing wherein:

FIG. 1 is a transverse section of a rotary engine provided with rotor cooling means embodying the invention; and FIG. 2 is a section taken substantially along the line 2—2 thereof.

DESCRIPTION OF THE PREFERRED EMBODIMENT

In the exemplary embodiment of the invention as disclosed in the drawing, a rotary engine structure generally designated 10 is shown to comprise an outer body 11 having an inner surface 12 defining an engine cavity, or working chamber, 13. Illustratively, surface 12 may define a two-lobed epitrochoidal surface conventionally utilized in rotary combustion engines.

A hollow rotor structure generally designated 14 is provided within cavity 13 and is defined by a plurality of arciform side walls 15 converging to a plurality of angularly spaced outer apices 16, each provided with a seal 17 slidably engaging surface 12 during revolution of the rotor in the operation of the engine.

The rotor is carried on an annular bearing 18 disposed about a shaft 19. The shaft is provided with an axial lubricant passage 20 having a radial inner portion 21 opening radially outwardly through the outer surface 22 of the shaft to a space 23 between split portions 18*a* and 18*b* of bearing 18. The lubricant may flow between bearing portions 18*a* and 18*b* to collecting spaces 24 and 25 in body 11 at the opposite ends of the bearing.

As indicated briefly above, the invention comprehends utilizing the lubricant fluid as a heat transfer coolant medium in removing heat from the apices 16 of the rotor for improved long life thereof. More specifically, heat is transferred from the respective apices by a heat pipe generally designated 26 comprising a fluid holder defining a space 27 in which is provided a body of vaporizable fluid 28. The fluid illustratively may comprise water, a water-alcohol mixture, etc., and as shown in FIG. 1, is thrown outwardly against the inner surface 29 of apex 16 by the centrifugal force generated in the rotation of the rotor in the operation of the engine. Thermal energy is transferred from the apex to the water causing vaporization thereof.

The vaporized water rises toward the center of rotation and is directed against an annular heat transfer wall 30 carried concentrically outwardly on bearing means 18. Annular wall 30 is sealed to the end walls 31 and 32 of rotor 14 by suitable seals 33 and 34, as shown in FIG. 2, thereby sealingly closing the fluid space 27.

The radially inner surface of heat transfer wall 30 may be provided with a pair of oppositely angled, helical grooves 35 and 36 opening at their axially adjacent ends to the space 23 between bearing portions 18*a* and 18*b* for receiving lubricant from passage 21 and permitting the flow of the lubricant through the grooves to the spaces 24 and 25 for recirculation with the lubricant passed thereto through the bearing means 18. Thus, heat transferred from the vaporized fluid in heat pipe space 27 through the wall 30 is removed from the rotor by the flowing lubricant coolant in grooves 35 and 36 so as to effectively maintain the rotor apices at the desired low temperature.

For improved heat transfer association of the heat transfer wall 30 with the vaporized fluid in space 27, the wall may be further provided with annular grooves 37 effectively defining a plurality of radially outwardly projecting fins 38 providing a preselected increased heat transfer surface for improved efficiency in the transfer of heat from the apices 16 to the lubricant coolant to effectively maintain the apiecs at the desired temperature.

If desired, the arciform side walls 15 may be overlaid with arciform insulating elements 39 to minimize heat transfer inwardly to the rotor from the combustion gas in chamber 13 thereby facilitating maintaining the rotor apices at lower temperatures.

As will be obvious to those skilled in the art, the insulating means 39 may be omitted and the rotor provided with insulating means intermediate the heat pipe means 26 to minimize heat transfer intermediate the apices.

As further obvious to those skilled in the art, the arrangement of the grooves 37 and fins 38 may be other than annular, such as helical, etc.

As shown in FIG. 2, a suitable inlet opening 40 may be provided in end wall 31 for introduction of the heat transfer fluid 28. A suitable threaded closure 41 may be provided for sealingly closing the opening.

As the heat exchange wall 30 is disposed in surrounding relationship to the bearing means 18, the heat transfer means may further be effective together with the lubricating oil flow in transferring heat from the bearing, thereby providing further extended useful life of the structure.

In a broad aspect, the invention comprehends transferring heat from an outer portion of the rotary engine to an inner portion thereof which is in heat transfer association with lubricant fluid circulated therethrough for lubricating the bearing means of the engine. The invention contemplates utilizing a fluid filled heat pipe which effectively transfers the heat from an outer portion of the rotor to the inner portion. A heat transfer member may be provided between the heat pipe and bearing for closing the inner end of the heat pipe and providing improved heat transfer to the lubricating fluid. The heat transfer member may be provided with suitable grooves or fins for providing improved heat transfer between the heat pipe fluid and lubricating fluid.

As shown in FIG. 1, the inwardly extending wall of the heat pipe 26 defines, with the adjacent side walls 15, a radially outer portion to which some of the heat transfer fluid from space 27 may spill over during operation of the engine. To permit return of such spilled-over fluid to the space 27, suitable passages may be provided in the heat pipe wall 26 adjacent the radially outer portion thereof.

The foregoing disclosure of specific embodiments is illustrative of the broad inventive concepts comprehended by the invention.

I claim:

1. In a rotary engine hollow rotor defined by arciform side walls converging to a plurality of angularly spaced outer apices, improved structure for cooling said rotor, comprising:

heat transfer means within the rotor comprising a rigid tubular wall concentrically within said side walls and having inwardly opening circumferentially extending helical groove means and outwardly opening circumferentially extending groove means;

heat pipe means extending inwardly from each of said apices to said heat transfer means and provided with a vaporizable fluid for transferring heat inwardly from said apices to said heat transfer means within said outwardly opening grooves means for apical cooling of said rotor; and means for flowing a lubricant heat transfer fluid in the helical path defined by said inwardly opening groove means.

2. The engine structure of claim 1 further including insulating means extending between said apices.

3. The engine structure of claim 1 wherein a tubular bearing is concentrically disposed within said heat transfer means with said inwardly opening groove means opening to said bearing and conducting bearing lubricant for utilizing the lubricant both to lubricate the bearing and transfer heat from said heat pipe means, said inwardly opening groove means comprising a pair of oppositely angled helical grooves extending from a rigid portion of the bearing, and said bearing is provided with a lubricant passage opening to said grooves at said midportion of the bearing.

* * * * *